US006032007A

United States Patent [19]

Yamaji et al.

[11] Patent Number: 6,032,007

[45] Date of Patent: Feb. 29, 2000

[54] DEVELOPING DEVICE HAVING MAGNETIC SEAL

[75] Inventors: Masaaki Yamaji, Yokohama; Toshiyuki Karakama, Shizuoka-ken, both of Japan

[73] Assignee: Canon Kabushiki Kaisha, Tokyo, Japan

[21] Appl. No.: 09/146,357

[22] Filed: Sep. 3, 1998

[30] Foreign Application Priority Data

Sep. 12, 1997 [JP] Japan ..... 9-265121

[51] Int. Cl.[7] ..... G03G 15/08

[52] U.S. Cl. ..... 399/104

[58] Field of Search ..... 399/103, 104, 399/267, 274, 275; 277/410, 629

[56] References Cited

U.S. PATENT DOCUMENTS

| | | | |
|---|---|---|---|
| 4,213,617 | 7/1980 | Salger | 277/12 |
| 5,790,923 | 8/1998 | Oguma et al. | 399/106 |
| 5,812,909 | 9/1998 | Oguma et al. | 399/103 |

FOREIGN PATENT DOCUMENTS

| | | |
|---|---|---|
| 3-013977 | 1/1991 | Japan . |
| 4-069691 | 3/1992 | Japan . |
| 7-281528 | 10/1995 | Japan . |
| 8-202153 | 8/1996 | Japan . |

*Primary Examiner*—Robert Beatty

*Attorney, Agent, or Firm*—Fitzpatrick, Cella, Harper & Scinto

[57] ABSTRACT

A developing device, a process cartridge and an image forming apparatus are provided which can suppress and prevent the slipping-through of a developer to the end portions of a developing sleeve and can suppress and prevent the leakage of the developer by a shock or the like. A developer sleeve 31 having a magnet roller 32 therein is disposed in the opening portion of a developing container 30, and magnet seal members 34 for regulating the movement of the toner are disposed in non-contact with the developing sleeve 31 on the outer peripheral surface of the opposite ends of the developing sleeve 31, which is adjacent to the developing container 30. The magnet roller 32 has a plurality of magnetic poles, and N and S poles are magnetized to multiple magnetic poles on the inner peripheral surfaces of the magnet seal members 34. The magnet roller and the magnet seal members are formed so that the peak value Br1 of the magnetic-flux density by each magnetic poles of the magnet roller in the direction of a normal to the surface position of the developing sleeve is smaller than the peak value Br2 of the magnetic-flux density by the opposing magnetic poles of the magnet seal members in the direction of the normal to the surface position of the developing sleeve.

6 Claims, 11 Drawing Sheets

DEVELOPING DEVICE HAVING MAGNETIC SEAL

BACKGROUND OF THE INVENTION

1. Field of the Invention

This invention relates to a developing device used in an image forming apparatus of the electrophotographic type or the electrostatic recording type to develop an electrostatic image on an image bearing member by the use of a magnetic developer.

2. Related Background Art

Certain image forming apparatus for forming an image by an electrophotographic recording method or the like, employ a process cartridge system in which an electrophotographic photosensitive member, which is an image bearing member, and process means acting on the electrophotographic photosensitive member are integrally made into a cartridge, and this cartridge is designed to be removably mountable on an image forming apparatus body.

According to this process cartridge system, by the process cartridge being interchanged, the maintenance of the main members of the apparatus can be performed by a user himself without resorting to a serviceman and therefore, the operability of the apparatus can be markedly improved. Therefore, this process cartridge system is widely used in image forming apparatuses such as printers.

In a developing device which is developing means contained in such a process cartridge, seal members for preventing a developer from flowing out of a developing area are provided on the opposite end portions of a developing sleeve, which is a developer image bearing member that is rotated while carrying the developer thereon and can convey the developer to the developing area for developing an electrostatic latent image.

An elastic material such as felt or formed rubber is widely utilized for the seal members for preventing the outflow of the developer. In FIGS. 12 and 13 of the accompanying drawings, there is shown a case of an example in which a seal member is used. FIG. 12 is a front view showing the essential portions of a developing device contained in a process cartridge according to the prior art, and FIG. 13 is a side view showing the essential portions of the developing device.

As shown in FIG. 12, a developing sleeve 31 carrying a developer thereon has a magnet roller 32 disposed therein. Also, as shown in FIG. 13, the developing sleeve 31 is rotatably supported by a developing container 30 through a sleeve bearing 35 provided at a predetermined location on the developing container 30 containing a developer therein, and the developer supplied from the developing container 30 may adhere to the surface of the developing sleeve 31 by the magnetic force of the magnet roller 32, and the thickness of the developer layer may be regulated to a predetermined thickness by a developing blade 33 bearing against the developing sleeve 31. Thereafter, the developer may be conveyed to a developing area which is a position opposed to a latent image on a photosensitive drum disposed at a location opposed to the developing sleeve 31 with the rotation of the developing sleeve 31, and the developer conveyed to the developing sleeve may adhere to the latent image, whereby developing may be effected.

Also, an elastic seal member 36 is mounted on the developing container 30 side of the developing sleeve 31 mounted on the developing container 30 at lengthwise opposite ends outside the developing area of the developing sleeve 31. This elastic seal member 36 is formed into a substantially arcuate cross-sectional shape along the outer peripheral surface of the developing sleeve 31, for example, by felt, formed rubber or the like, and the elastic seal member 36 is brought into pressure contact with the outer peripheral surface of the developing sleeve 31 to thereby prevent the developer from flowing from the surface of the developing sleeve 31 to the lengthwise end portion thereof.

In a developing device using the elastic seal member of the above-described construction, the elastic seal member 36 is in pressure contact with substantially a half of the outer peripheral surface of the opposite end portions of the developing sleeve 31. So, this has led to a problem that the load of the developing sleeve 31 rotated during the developing operation and the elastic seal member 36 is deteriorated by its contact with the developing sleeve 31, and there is another problem that the toner, though slightly, enters from the gap between the developing sleeve 31 and the elastic seal member 36. These problems have caused torque to become high and the fluctuation of the torque has become so great to cause the irregularity of rotation, and this has adversely affected image formation.

Therefore, to solve these problems, there has been proposed a method of disposing, instead of elastic seal members, magnet seal members at predetermined intervals along the outer peripheral surface of the opposite end portions of the developing sleeve at the locations on the developing sleeve at which the elastic seal members are provided, to thereby prevent the outflow of the developer.

FIG. 14 of the accompanying drawings shows a front view of a developing device using magnet seal members. Each of the magnet seal members 37 provided at the opposite ends of a developing sleeve 31 is a magnet formed into a substantially arcuate cross-sectional shape along the outer periphery of the developing sleeve 31, and has many N and S poles magnetized on the inner peripheral surface thereof. Also, the magnet seal members 37 are disposed with a predetermined gap g relative to the outer peripheral surface of the developing container side at the opposite end portions of the developing sleeve 31 having a magnet roller 32 therein, and is mounted on the developing container with the developing sleeve 31 while keeping the gap g. The magnet seal members 37 have magnetic poles provided on the inner peripheral surfaces thereof at locations opposed to the magnetic poles of the magnet roller.

These magnet seal members 37 restrain a developer between the end portions of the developing sleeve and the magnet seal member by a magnetic field formed by the magnet roller 32 in the developing sleeve 31 and the magnet seal members 37 to form a seal portion. And the developer which has moved to the lengthwise end portion of the developing sleeve can be checked by the seal portion to thereby prevent the outflow of the developer from the end portions of the developing sleeve.

When the above-described magnet seals are used, the developing sleeve and the magnet seal members are kept in non-contact with each other and the rotational torque of the developing sleeve becomes remarkably small and therefore, a driving motor may be a compact and inexpensive one. Also, the fluctuation of the rotational torque is small and it becomes difficult for the irregularity of the rotation of the developing sleeve and the photosensitive drum to occur and there is not the wear or the like of the magnet seal members and therefore, the use thereof is semipermanent and the recycling thereof can also be coped with.

However, when the above-described magnet seal member according to the prior art is used, sufficient consideration is not given to the relations in magnetic-flux density and magnetic force between the fixed magnet in the developing sleeve and the magnet seal members and therefore, there has been the problem that depending on the situation of use, the developer may leak from the end portions of the developing sleeve.

For example, during the use of the developing device, the developer carried on the developing sleeve moves a great deal to the lengthwise end portions of the developing sleeve with the rotation of the developing sleeve, and this has led to the problem that the developer, which has thus moved, slips through the seal portions formed between the end portions of the developing sleeve and the magnet seal members.

SUMMARY OF THE INVENTION

It is an object of the present invention to provide a developing device capable of sealing a developer by a magnetic force.

It is another object of the present invention to provide a developing device which prevents a developer from slipping through a magnetic seal.

It is still another object of the present invention to provide a developing device comprising:

a developing container containing a magnetic developer therein;

a developer carrying member provided in the opening portion of the developing container for carrying and conveying the developer thereon;

a developer carrying magnet provided in the developer carrying member for causing the developer carrying member to carry the developer thereon by a magnetic force; and magnetic seal members provided on the end portions of the developer carrying member for effecting the sealing of the developer by a magnetic force;

wherein on the surface of the developer carrying member, the magnitude Fr1 of the magnetic force by the developer carrying magnet in the direction of a normal is smaller than the magnitude Fr2 of the magnetic force by the magnetic seal members in the direction of a normal.

Further objects of the present invention will become apparent from the following description.

DESCRIPTION OF THE PREFERRED EMBODIMENTS

An embodiment of the present invention will hereinafter be described with reference to the drawings.

Figure 1:
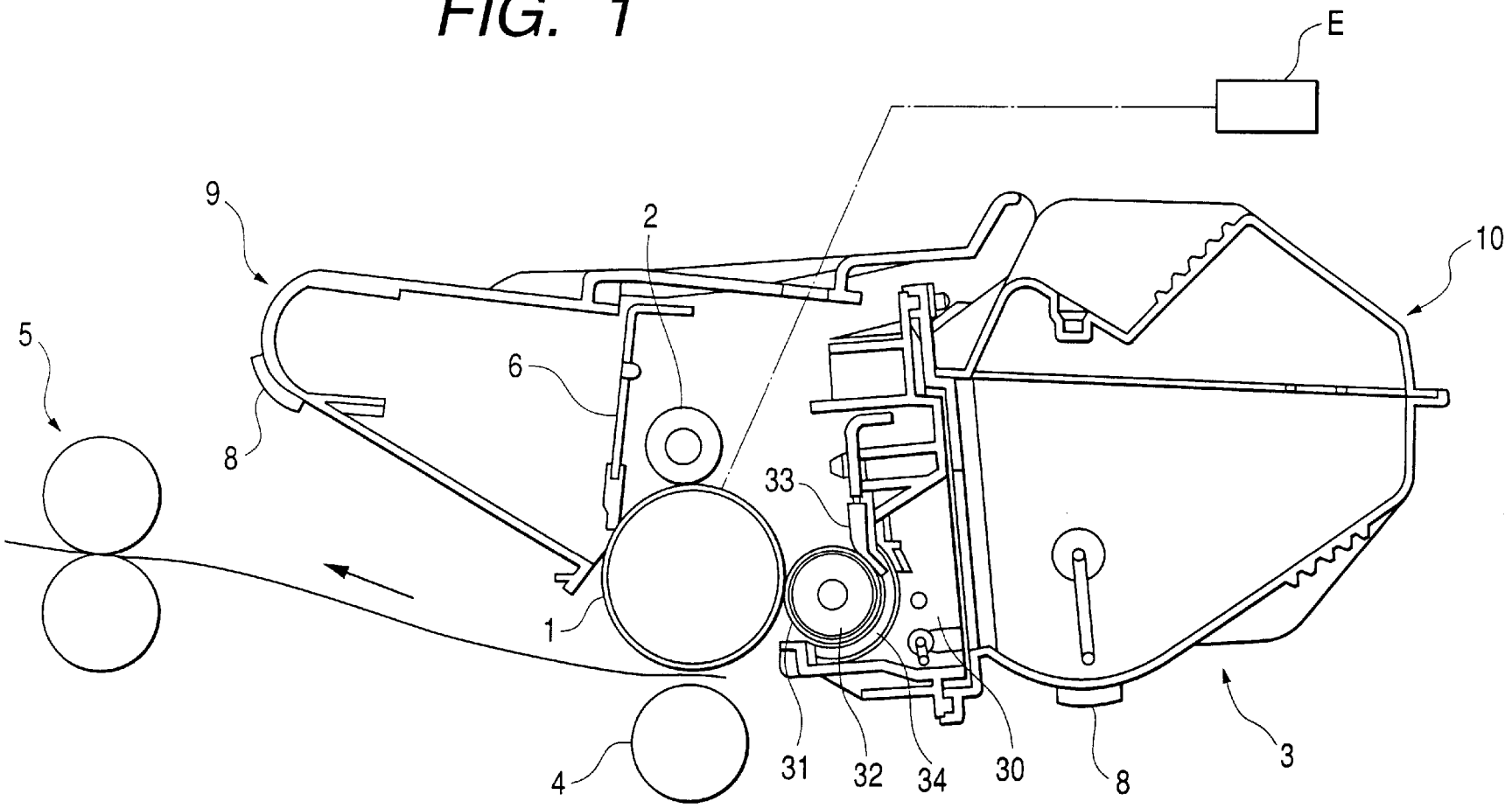
FIG. 1 is a schematic view showing the essential portions of an image forming apparatus utilizing a transfer-type electrophotographic process of a process cartridge mounting and dismounting type to which the present invention is applied.

FIG. 1 is a schematic view showing the essential portions of an image forming apparatus utilizing a transfer type electrophotographic process of the process cartridge mounting and dismounting type having a developing device to which the present invention is applied.

A process cartridge 10 removably installed in an image forming apparatus, such as a laser printer, is comprised of a photosensitive drum 1, which is an electrophotographic photosensitive member of a rotatable-photosensitive-drum type as an image bearing member on the surface of which an electrostatic latent image is formed. The drum 1 is disposed so as to be capable of being rotatively driven in a clockwise direction. And three process instruments, i.e., a charging device 2, a developing device 3 and a cleaning device 6, are collectively disposed around the photosensitive drum 1 at predetermined locations in a cartridge housing 9.

The above-described process cartridge 10, when mounted in a predetermined manner with respect to the body of the image forming apparatus, becomes such that the process cartridge 10 side and the image forming apparatus body side become mechanically and electrically coupled to each other and the underside of the photosensitive drum 1 of the process cartridge 10 come to bear against a transfer roller 4 disposed in the image forming apparatus body, and the apparatus becomes capable of executing image formation. Also, design is made such that when the process cartridge 10 is installed in the image forming apparatus, a process cartridge insertion guiding and holding portion 8 on the image forming apparatus body side bears against a predetermined location on the cartridge housing 9.

The above-described process cartridge is such that charging means, developing means, or cleaning means and a photosensitive drum are integrally made into a cartridge, which is removably mountable with respect to the image forming apparatus body. However, this is not restrictive, and at least one of the charging means, the developing means, and the cleaning means and the photosensitive drum can be integrally made into a cartridge which is removably mountable in the image forming apparatus body. Further, at least the developing means and the photosensitive drum may be integrally made into a cartridge which is removably mountable in the image forming apparatus body.

When the image forming apparatus effects image formation by the process cartridge of the above-described construction, the photosensitive drum 1 is uniformly charged by the charging device 2, whereafter correspondingly to an image information signal, the surface of the photosensitive drum 1 is exposed to a laser beam from image exposure means E provided outside the process cartridge 10 and image exposure is effected, whereby an electrostatic latent image is formed on the photosensitive drum 1.

The electrostatic latent image formed on the photosensitive drum 1 is developed by the developing device 3. This visualized image is transferred onto a transfer material at a transfer portion which is the opposed portion of the photosensitive drum 1 and a transfer roller 4 as transfer means disposed at a location opposed to the photosensitive drum 1, which is outside the process cartridge, by the transfer roller 4 and by an electrostatic force and pushing pressure. The transfer material onto which the image has been transferred is conveyed to a fixating device 5 of a heat-fixation type or the like, whereby the visualized image on the transfer material is fixated, and the transfer material is discharged as an image-formed article (a print or a copy) out of the apparatus. Also, after the transfer of the toner image onto the transfer material, the surface of the photosensitive drum may be cleaned with an adhering contaminant such as residual toner on the photosensitive drum 1 removed and may be repetitively used for image formation.

In the foregoing, the peripheral velocity of the photosensitive drum 1 was 94 mm/sec., the outer diameter thereof was 30 mm, the peripheral velocity of a developing sleeve 31 was 111 mm/sec., and the outer diameter of the developing sleeve 31 was 16 mm. The direction of rotation of the sleeve 31 was a forward direction relative to the photosensitive drum 1. The spacing between the photosensitive drum 1 and the developing sleeve 31 was 0.3 mm.

Figure 2:
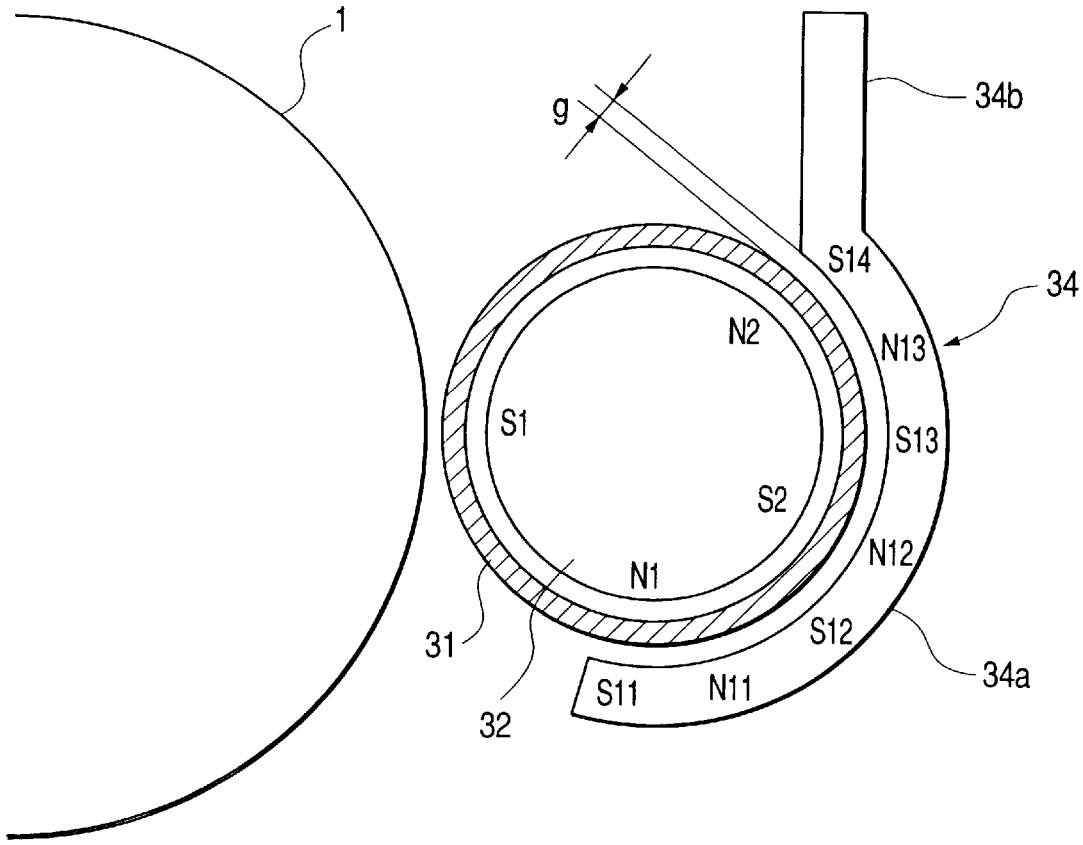
FIG. 2 is an illustration, partly in cross-section, showing the essential portions of a developing device.
Figure 3:
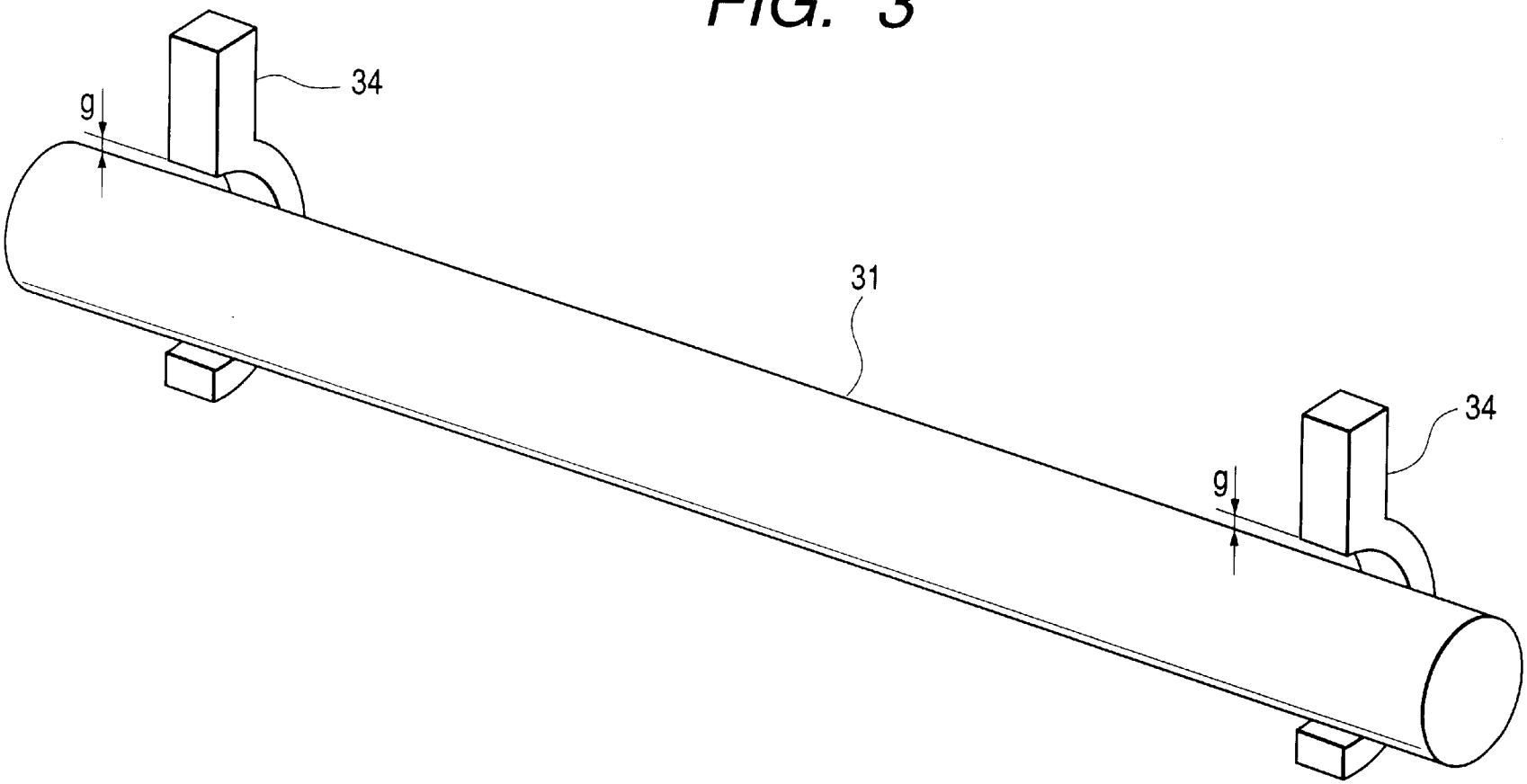
FIG. 3 is a perspective view showing a developing sleeve and magnet seal members.

The developing device 3 disposed in the process cartridge 10 will now be described with reference to FIGS. 1 to 5. FIG. 2 is an illustration, partly in cross-section, showing the essential portions of the developing device, FIG. 3 is a perspective view of the developing sleeve and magnet seal members, FIG. 4 is a lengthwise illustration, partly in cross-section, of the essential portions of the developing device, and FIG. 5 is a perspective view showing the magnetization pattern of the magnet seal member.

As shown in FIG. 1, the developing sleeve 31, which is a developer carrying member which that can carry and convey a magnetic toner which is a magnetic developer on the surface thereof, is disposed in an opening portion provided at a location on a developing container 30 containing the magnetic toner therein, which is opposed to the photosensitive drum 1, and a regulating blade 33 as developer layer thickness regulating means bears against the surface of the developing sleeve 31. Also, on the developing container 30 side at the opposite ends of the developing sleeve 31, magnet seal members 34 for regulating the movement of the toner carried on the developing sleeve 31 in the lengthwise direction of the developing sleeve 31 are disposed in non-contact with the developing sleeve 31, and an agitating device or the like for agitating the toner is provided in the developing container 30, whereby the developing device 3 is constituted. As the developing sleeve 31, use is made of a non-magnetic cylindrical sleeve formed of aluminum, stainless steel or the like.

Figure 4:
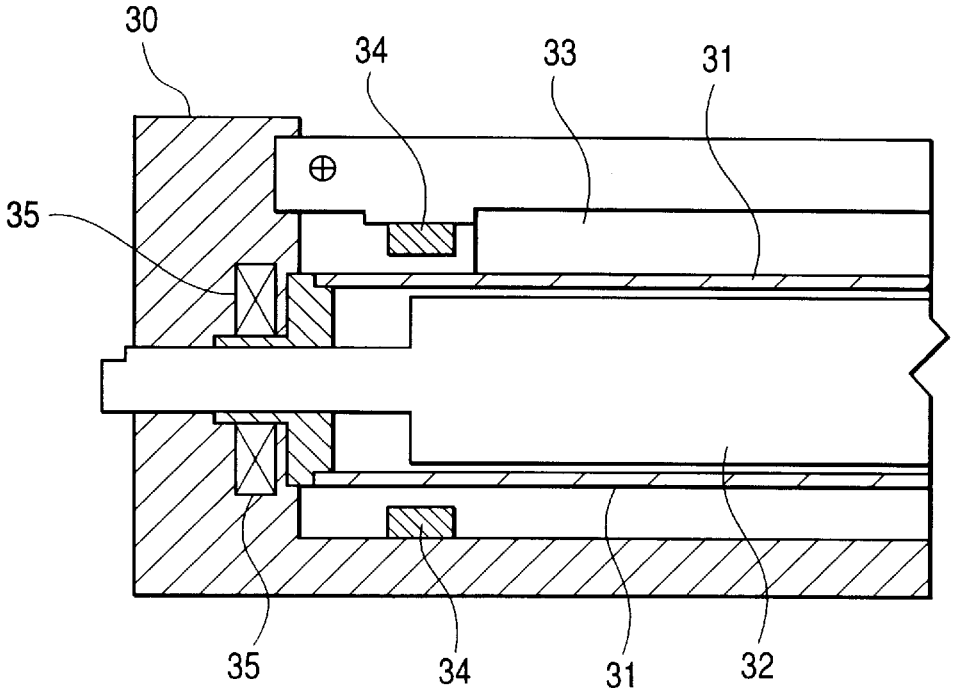
FIG. 4 is a lengthwise illustration, partly in cross-section, of the essential portions of the developing device.
Figure 5:
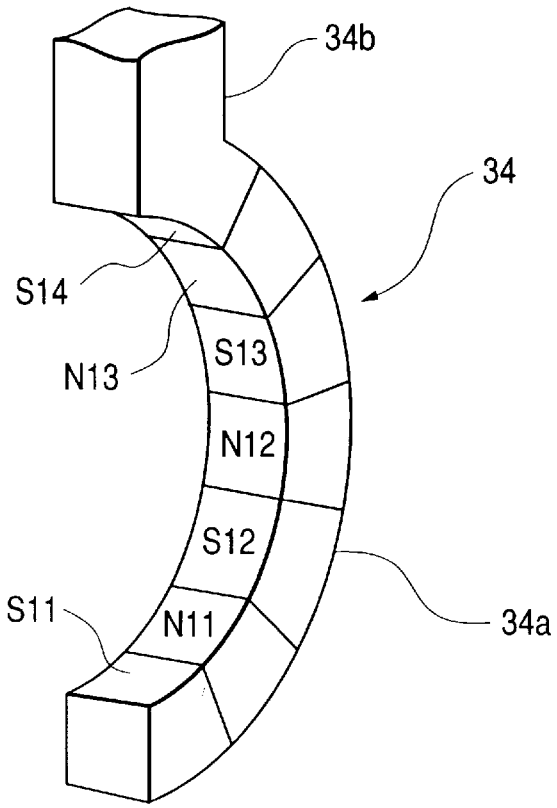
FIG. 5 is a perspective view showing the magnetization pattern of the magnet seal member.

As shown in FIG. 4, the developing sleeve 31 disposed in the opening portion of the developing container 30 is rotatably held through a sleeve bearing 35 provided at a predetermined location in the developing container 30. Also, a magnet roller 32, which is a roller-like magnet, is fixedly disposed in the developing sleeve 31. In the developing device of the present embodiment, the developing sleeve 31 is rotatable in a counter-clockwise direction.

As shown in FIG. 2, the magnet roller 32 disposed in the developing sleeve 31 has a plurality of magnetic poles, i.e., two N poles N1 and N2 and two S poles S1 and S2, on the surface thereof. Accordingly, the developing sleeve 31 can be rotated in the counter-clockwise direction to cause the magnetic toner supplied in the developing container 30 to adhere to the surface of the developing sleeve by the magnetic force of the magnet roller 32 and convey the magnetic toner toward the photosensitive drum. Also, the surface of the developing sleeve 31 is pressed in the opening portion of the developing container 30 by the regulating blade 33 bearing against the surface of the developing sleeve 31 to thereby regulate the amount of the developer on the developing sleeve 31 and regulate the thickness of the developer layer carried and conveyed to a developing area in which the developing sleeve and the photosensitive drum are opposed to each other.

The magnetic toner, having had its layer thickness regulated by the regulating blade 33 and carried on and conveyed by the developing sleeve 31, can visualize and develop the electrostatic latent image formed on the photosensitive drum 1 rotated in a clockwise direction. When the electrostatic latent image is to be developed, a vibration bias voltage comprising a DC voltage superposed on an AC voltage is applied to the developing sleeve 31. A rectangular wave, a sine wave or the like can be used as the waveform of the vibration bias voltage.

As shown in FIG. 5, each of magnet seal member 34, disposed on the opposite ends of the developing sleeve 31, has N and S poles magnetized into multiple magnetic poles and formed on the inner surface thereof. Specifically, it has four S poles S11, S12, S13 and S14 and three N poles N11, N12 and N13 on the inner surface thereof, and the S and N poles are alternately disposed.

In the present embodiment, for example, the pole S2 of the magnet roller 32 and the pole N12 of the magnet seal member 34 are disposed in opposed relationship with each other, and the magnetic poles of the magnet roller 32 and the magnetic poles of the magnet seal members 34 together can form an N-S forward magnetic field.

The peak value of the magnetic-flux density of each magnetic pole of the magnet roller 32 fixed in the developing sleeve 31 on the surface of the sleeve in the direction of a normal to the surface of the sleeve was $400\times10^{31\ 4}$ to $900\times10^{-4}$ T(tesla). Also, the magnet seal members 34 were injection-molded articles of a width 4 mm provided with a nylon binder containing magnetic powder of Nd(neodymium)-Fe—B(boron), and the spacing g between the magnet seal members 34 and the developing sleeve 31 were 0.1 to 0.7 mm. The peak value of the magnetic-flux density of each magnetic pole of the magnet seal members 34 on the surface of the sleeve in the direction of a normal to the surface of the sleeve was $1000\times10^{-4}$ to $2200\times10^{-4}$ T(tesla).

Figure 6A:
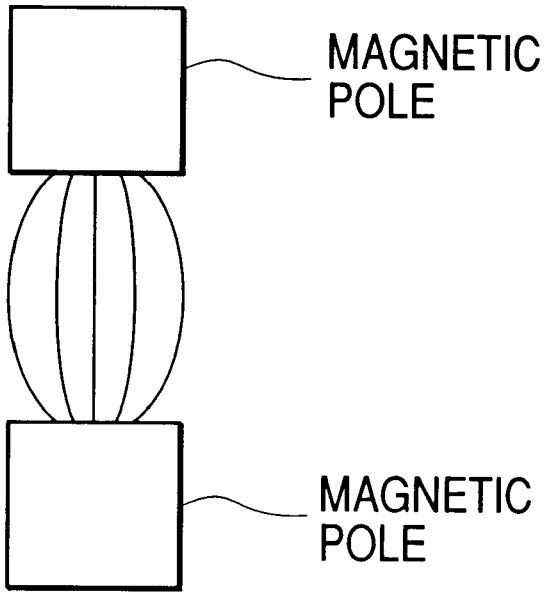
FIG. 6A is a typical view representing the distribution of the lines of magnetic force by magnetic poles when an opposed magnetic pole is present.
Figure 6B:
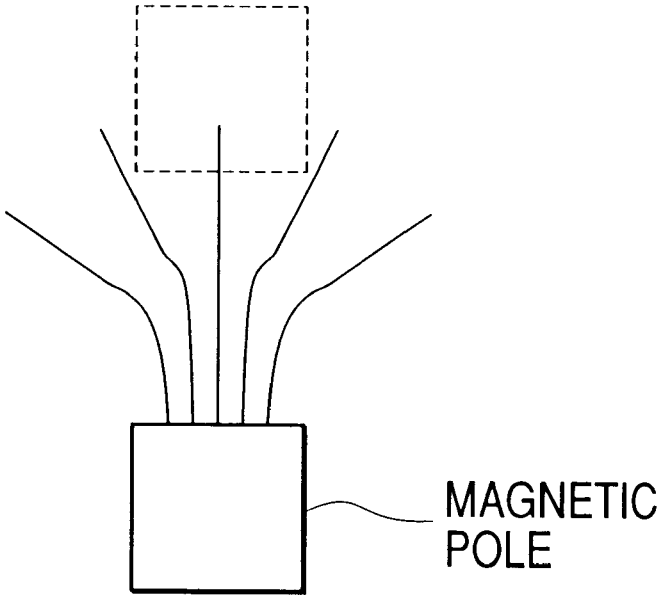
FIG. 6B is a typical view representing the distribution of the lines of magnetic force by magnetic poles when an opposed magnetic pole is absent.

FIGS. 6A and 6B are typical views representing the distribution of the lines of magnetic force by opposed magnetic pole. FIG. 6A shows a case where the opposed magnetic pole is present, and FIG. 6B shows a case where the opposed magnetic pole is absent.

As shown in FIG. 6A, generally, when there is an opposed magnetic pole to a certain magnetic pole, lines of magnetic force concentrate in a direction perpendicular to the magnetic pole and therefore, if there is a toner near the lines of magnetic force, the magnetic toner will be arranged along these lines of magnetic force. However, when as shown in FIG. 6B, there is no opposed magnetic pole, lines of magnetic force are diffused in oblique directions and becomes sparse. The magnetic toner is arranged along these lines of magnetic force.

When, in order to dispose lines of magnetic force between the opposed magnetic poles as shown in FIG. 6A, the magnet seal members are disposed on the end portions of the developing sleeve, the toner arranged along these lines of magnetic force plays the role of a seal and it is considered that the sealing property becomes good. Also, when as shown in FIG. 6B, an opposed magnetic pole is absent, it is considered that the lines of magnetic force become sparse and are inferior in the sealing property. From this fact, use has heretofore been made of means for disposing magnet seal members on the end portions of the developing sleeve so as to concentrate lines of magnetic force and improve the sealing property.

In order to improve the sealing property, magnet seal members are disposed on the end portions of the developing sleeve. And when opposed magnetic poles are constructed by the magnet in the sleeve and the magnet seal members to thereby concentrate lines of magnetic force and improve the sealing property, the developing sleeve is rotated with the developer carried on the surface thereof, the magnetic toner on the developing sleeve will move toward the end portions by the diffusing action and be checked at the locations of the magnet seal members. Certainly, by concentrating the lines of magnetic force as shown in FIG. 6A, the leakage of the developer by a shock or the like can be suppressed and prevented, but in some cases, the sealing property to the diffusing action of the magnetic toner by the rotation of the developing sleeve is not always sufficient.

That is, when the magnetic-flux density of the magnet roller in the direction of the normal becomes too great, too much of the magnetic toner on the developing sleeve is held and therefore, the amount of toner moving toward the end portions of the developing sleeve by the diffusing action of the magnetic toner by the rotation of the sleeve increases and the slipping through of the developer occurs.

It has been found that if the magnetic force acting on the developing sleeve and the magnet seal members is simply made great, the sealing capability will not be enhanced, but the relation of magnitude between the magnetic force working by the magnet roller and the magnetic force working by the magnetic seals affects the slipping-through of the developer.

That is, the leakage of the developer can also be suppressed and prevented by adjusting the values of the magnitude Fr1 of the magnetic force by the magnet roller 32 in the direction of the normal to the surface of the developing sleeve and the magnitude Fr2 of the magnetic force by the magnet seal member at the same position in the direction of the normal to the surface of the developing sleeve.

Specifically, by making the magnitude Fr2 of the magnetic force solely by the magnet seal member in the direction of the normal to the surface position of the developing sleeve sufficiently greater than the magnitude Fr1 of the magnetic force solely by the magnet roller 32 in the developing sleeve in the direction of the normal to the surface position of the developing sleeve in an area opposed to the magnet seal member, the sealing property can be made good.

A description will hereinafter be provided of a case where the slipping-through or the like of the developer from the end portions of the developing sleeve is prevented by adjusting the magnetic force Fr.

Figure 7:
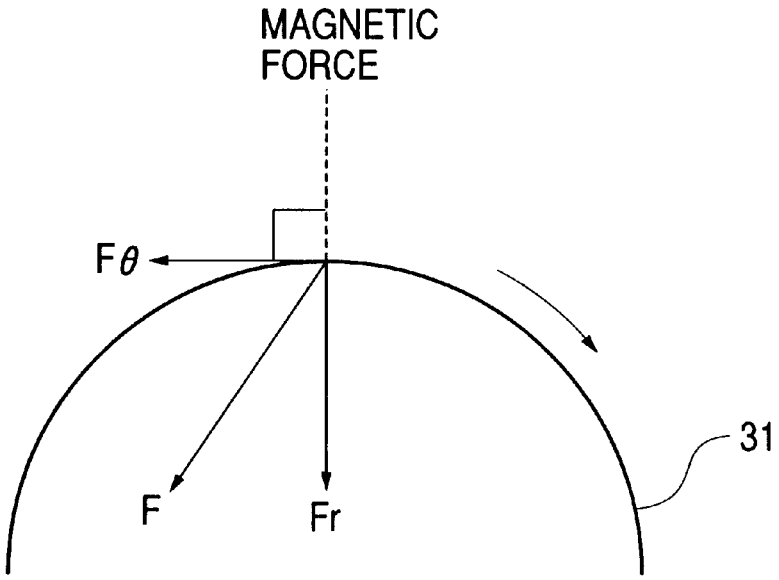
FIG. 7 is an illustration of essential portions showing a magnetic force on a sleeve.

FIG. 7 is an illustration of the essential portions for illustrating the magnetic force Fr on the developing sleeve. In FIG. 7, F indicates the magnetic force on the developing sleeve 31, Fr indicates the magnetic force on the developing sleeve 31 in the direction of the normal to the surface of the sleeve, and Fθ indicates the magnetic force on the developing sleeve 31 in the tangential direction of the surface of the sleeve.

Here, the magnetic force Fr is as shown in the following expression of proportion:

$$Fr^{\alpha}\{B2(r)-B2(r+\Delta r)\}/\Delta r$$

where $B2(r)=B2r(r)+B2\theta(r)$, $B2(r+\Delta r)=B2r(r+\Delta r)+B2\theta(r+\Delta r)$.

Here, $Br(r)$ is the magnetic-flux density [gauss] on the developing sleeve in the direction of the normal, $Br(r+\Delta r)$ is the magnetic-flux density [gauss] at a height of 0.2 mm over the developing sleeve in the direction of the normal, $B\theta(r)$ is the magnetic-flux density [gauss] on the developing sleeve in the direction of the normal, and $B\theta(r+\Delta r)$ is the magnetic-flux density [gauss] at a height of 0.2 mm over the developing sleeve in the direction of the normal.

Accordingly, if $\{B2(r)-B2(r+\Delta r)\}/\Delta r$ is found, the relative magnitude of the magnetic force Fr can be known, and the form of distribution of the magnetic force Fr, the peak position of the magnetic force Fr, etc. can be known.

Also, if $\Delta r$ is fixed, $Fr^{\alpha}\{B2(r)-B2(r+\Delta r)\}$, and it follows that $\{B2(r)-B2(r+\Delta r)\}$ can be found.

Actually, r was the radius of the developing sleeve, $\Delta r$ was 0.2 mm, the magnetic-flux densities $Br(r)$, $Br(r+\Delta r)$, $B\theta(r)$ and $B\theta(r+\Delta r)$ were measured by the use of the gauss meter of Bell, Inc. which will be described later, and from the result of the measurement, $\{B2(r)-B2(r+\Delta r)\}$ was found by calculation and the relative value of the magnetic force Fr was found.

Figure 8:
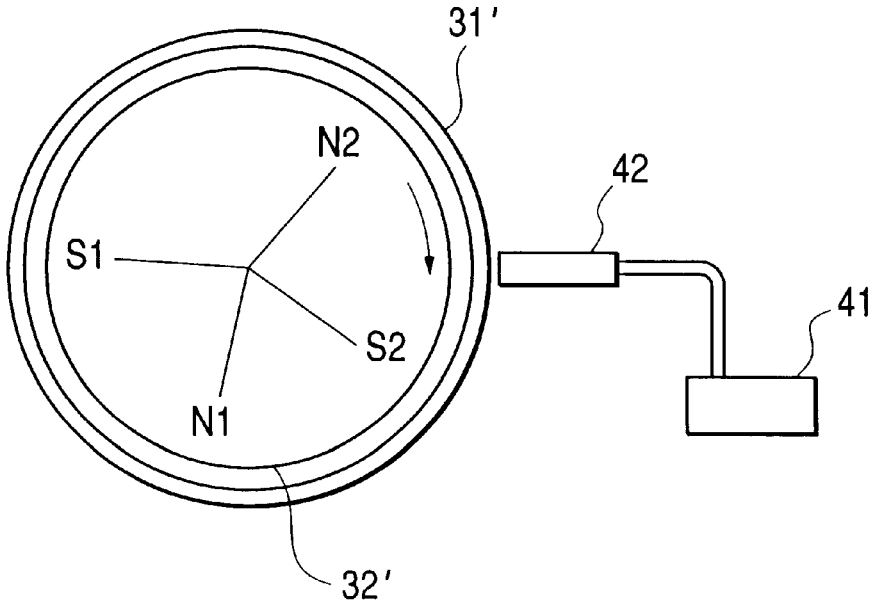
FIG. 8 is a schematic view showing a method of measuring the magnetic-flux density of a magnet roller.

A method of measuring the magnetic-flux density will hereinafter be described. FIG. 8 is a schematic view showing a method of measuring the magnetic-flux density on the developing sleeve or at a position of 2 mm over the sleeve in the direction of the normal and the magnetic-flux density in the tangential direction with the magnet roller being single (the magnet seal members being not opposed thereto). For the measurement, the gauss meter model 9903 of Bell, Inc. was used. Also, the design was made such that the developing sleeve 31' and the gauss meter were horizontally fixed and the magnet roller 32' in the sleeve was rotatably disposed.

As shown in FIG. 8, near the surface of the developing sleeve 31', the measuring surface of the two-axis type probe 42 (YOA99-1802 produced by Bell, Inc.) is disposed with some spacing kept with respect to the surface of the developing sleeve 31', and is fixed so that the center of the developing sleeve 31' and the center of the probe 42 may be on substantially the same horizontal plane, and the probe 42 is connected to the gauss meter 41. So, the magnetic-flux densities on the developing sleeve 31' or at a position of 0.2 mm over the sleeve in the direction of the normal and the tangential direction can be measured.

The developing sleeve 31' and the magnet roller 32' are disposed substantially concentrically with each other, and the spacing between the developing sleeve 31' and the magnet roller 32' may be considered to be equal at any point. Accordingly, by the magnet roller 32' being rotated, the magnetic-flux densities on the developing sleeve 31' or at a position of 0.2 mm over the sleeve in the direction of the normal and the tangential direction can be measured relative to all of the peripheral directions of the sleeve. Also, the magnet roller 32' has magnetic poles N1, S2, N2 and S1 disposed at a predetermined angle and is rotated in the direction of arrow of FIG. 8 and therefore, for example, the angle of the magnetic pole S2 assumes a greater value than the angle of the magnetic pole N1. That is, the measurement was effected in a direction in which the downstream side increases in angle relative to the counter-clockwise direction which is the direction of movement of the sleeve in FIG. 1.

The magnetic force of the magnet seal members when the magnet seal members 34 were single (the magnet roller is absent) was found by fixing the magnet seal members onto a rotatable table, fixing the above-described probe with a predetermined spacing kept with respect to the magnet seal members, and rotating the rotatable table to thereby likewise measure the magnetic-flux densities on the developing sleeve 31 or at a position of 0.2 mm over the sleeve in the direction of the normal and the tangential direction.

The magnetic force Fr on the developing sleeve was variously changed and observed, and as the result, it has been found that the sealing property when the developing device is durably used is related to the magnetic force on the developing sleeve 31.

When instead of a case where the magnetic-flux density on the surface of the developing sleeve was measured with the magnet seal members disposed on the developing sleeve, the magnetic-flux density at the surface position of the developing sleeve for the magnet seal members singly and the magnet roller 32 singly was measured and each magnetic force was calculated from this magnetic-flux density and the magnitudes of these magnetic forces were compared with each other, it has been found that the magnitude of the magnetic force is related to the sealing property when the developing device is durably used.

As a conclusion, the sealing property can be made good by forming the magnet roller and the magnet seal members so that the magnitude Fr2 of the magnetic force for the magnet seal members solely in the direction of the normal to the surface position of the developing sleeve may become sufficiently greater than the magnitude Fr1 of the magnetic force in the direction of the normal to the surface position of the developing sleeve in an area opposed to the magnet seal members for the magnet roller 32 solely in the developing sleeve.

Figure 9A:
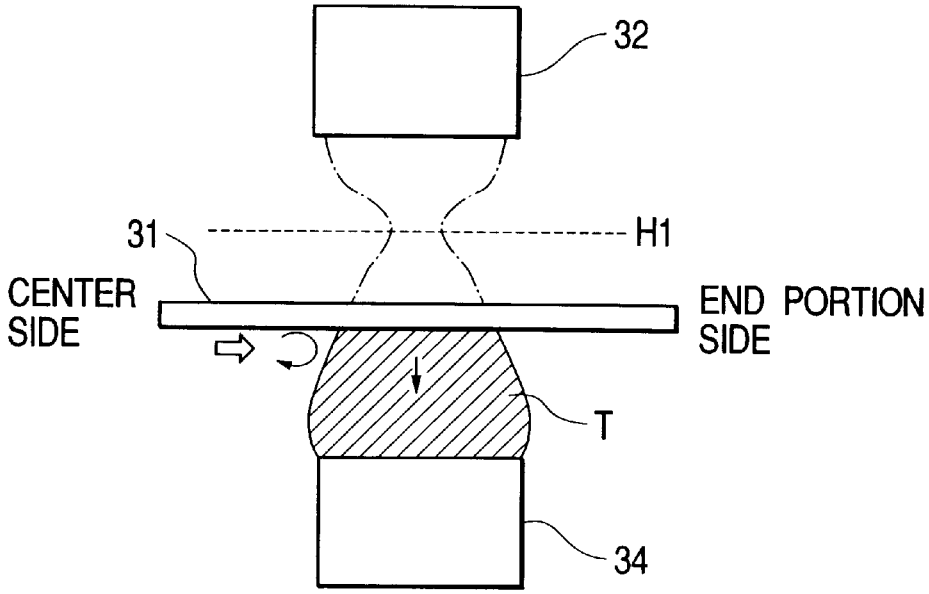
FIG. 9A is a typical view showing the restrained state of a toner when the magnetic force on the developing sleeve acts in a direction to be attracted toward the magnet seal member side.
Figure 9B:
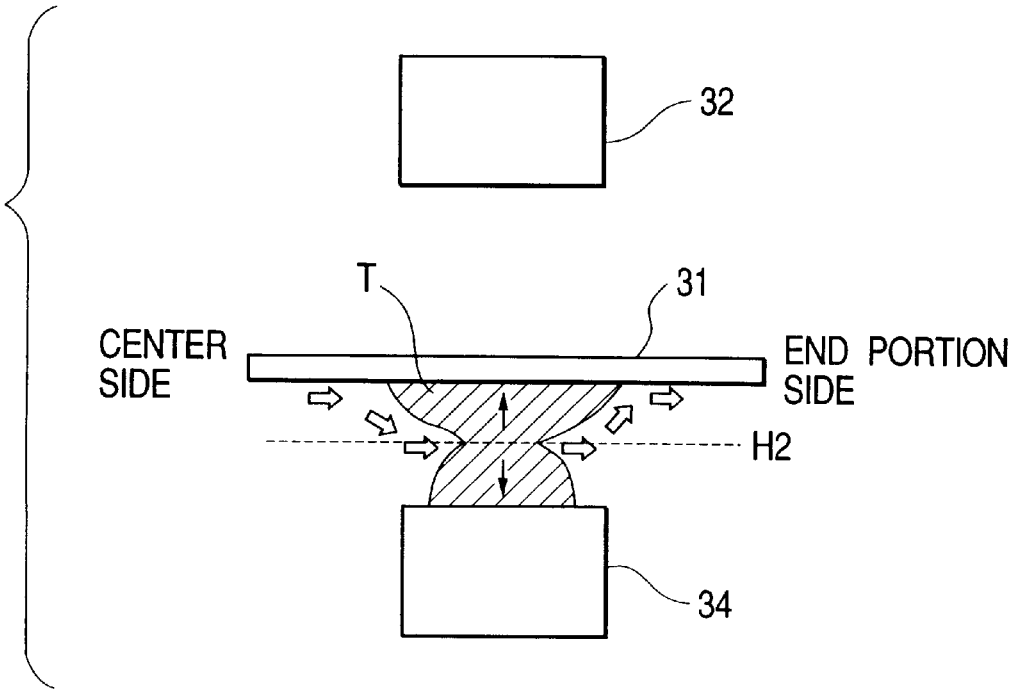
FIG. 9B is a typical view showing the restrained state of the toner when the magnetic force on the developing sleeve acts in a direction to be attracted toward the magnet roller side.

The reason for what has been described above will now be considered by the use of the typical views of FIGS. 9A and 9B showing the restrained state of the magnetic toner on the developing sleeve 31. Consider a case where as shown in FIG. 9A, the magnetic force Fr on the developing sleeve 31 which is Fr1<Fr2 acts in a direction to be attracted toward the magnet seal member 34 side, and a case where as shown in FIG. 9B, the magnetic force Fr on the developing sleeve 31 which is Fr1>Fr2 acts in a direction to be attracted toward the magnet roller 32 side.

When the developing sleeve 31 carrying the toner thereon is rotated, the magnetic toner on the developing sleeve 31 moves toward the end portion by the diffusing action and is checked by the seal at the position of the magnet seal member 34.

In this case, when as shown in FIG. 9A, the magnetic force Fr on the developing sleeve 31 is attracted toward the magnet seal member 34 and acts, the magnetic force Fr in the direction of the normal between the magnet seal member 34 and the magnet roller 32 has a balancing point between the developing sleeve 31 and the magnet roller 32. Assuming that this balancing position is H1, a force attracted to the magnet roller 32 works on the side more adjacent to the magnet roller 32 than to the balancing position H1 of the magnetic force Fr, and a force attracted to the magnet seal member 34 works on the side more adjacent to the magnet seal member 34 than to the balancing position H1. Accordingly, the magnetic toner on the developing sleeve 31 held in the area wherein the magnet seal member and the magnet roller are opposed to each other is all attracted to the magnet seal member 34 side and forms a seal portion.

To prevent the diffusion and movement of the magnetic toner stagnant and held in the seal portion (the area in which the magnet seal member and the magnet roller are opposed to each other) toward the end portion, the diffusion and movement of the magnetic toner on the lengthwise central side of the sleeve toward the end portion can be prevented during the time until the magnetic toner supplied from the developing container to the opening portion returns into the developing container. On the lengthwise central side of the developing sleeve on which the magnetic toner is held in this seal portion, the magnetic toner diffused and moved in the lengthwise direction by the rotation of the sleeve collides with the stagnant and held magnetic toner and is checked thereby and is attracted to the magnet seal member 34 side and therefore, is attracted back in a direction indicated by arrow in FIG. 9A, i.e., toward the lengthwise central side of the developing sleeve, thereby deterring the movement toward the end portion.

Also, on the lengthwise end portion side of the developing sleeve on which the magnetic toner is stagnant and held in the area wherein the magnet seal member and the magnet roller are opposed to each other, even if the magnetic toner on this developing sleeve 31 tries to move toward the end portion by the diffusing action by the rotation of the toner, the magnetic toner is attracted to the magnet seal member 34 side and therefore the diffusion and movement thereof can be prevented. And even if it is once moved to the end portion side, it is attracted to the magnet seal member 34 side and collects there and therefore, by the collecting toner, a checking force works and further diffusion can be prevented.

However, when as shown in FIG. 9B, the magnetic force Fr on the developing sleeve 31 is attracted to and acts on the magnet roller 32 side, the magnetic force Fr in the direction of the normal between the magnet seal member 34 and the magnet roller 32 has a balancing point between the developing sleeve 31 and the magnet seal member 34. Assuming that this balancing position is H2, a force attracted to the developing sleeve 31 side works on the side more adjacent to the developing sleeve 31 than to the balancing position H2 of the magnetic force Fr, and a force attracted to the magnet seal member 34 side works on the side more adjacent to the magnet seal member 34 than to the balancing position H2. That is, the magnetic toner held in the area wherein the magnet seal member and the magnet roll are opposed to each other is attracted neither to the magnet seal member 34 nor to the magnet roller 32 at the balancing position H2 (located between the surface of the developing sleeve and the magnet seal member) of the magnetic force Fr, and the amount of restrained toner is small and the seal is in a thin state.

On the lengthwise central side of the developing sleeve on which the magnetic toner is stagnant and held in the area wherein the magnet seal member and the magnet roller are opposed to each other, the magnetic toner diffused and moved in the lengthwise direction of the sleeve by the rotation of the sleeve collides with the stagnant and held magnetic toner and rides onto the stagnant magnetic toner, and slips through the thin portion of the seal at the balancing position H2 of the magnetic force Fr and moves toward the end portion, whereby the slipping-through of the developer occurs.

Also, on the lengthwise end portion side of the developing sleeve on which the magnetic toner is stagnant and held in the area wherein the magnet seal member and the magnet roller are opposed to each other, the toner on the end portion side of the lump of the magnetic toner stagnant and held on the developing sleeve 31 may sometimes be moved toward the end portion by the diffusing action.

If such toner moved toward the end portion is intactly statically placed, a checking force will work by the statically placed toner and further diffusion can be prevented. However, this moved toner is attracted toward the surface of the developing sleeve 31 by the magnetic force of the magnet roller 32 and therefore, is further moved toward the end portion by the diffusing action by the rotation of the developing sleeve 31, and the toner is sequentially diffused and moved, whereby the slipping-through of the developer seems to occur.

By thus making the magnitude Fr2 of the magnetic force singly by the magnet seal member in the direction of the normal to the surface position of the developing sleeve greater than the magnitude Fr1 of the magnetic force singly by the magnet in the developing sleeve in the direction of the normal to the surface position of the developing sleeve, there is provided a developing device in which the slipping-through of the developer from the lengthwise end portion of the developing sleeve can be suppressed and prevented.

Now, in the magnet roller and the magnet seal members, the magnetic pole construction of the magnet roller in the lengthwise intermediate developing area of the developing sleeve is set by a developing characteristic, a developer conveying property, etc. Accordingly, only the portion opposed to the magnet seal members is made into a special magnetic pole construction, the cost of the magnet roller will become higher and therefore, it is advantageous to make this portion also the same construction as that of the central portion.

As regards the magnet roller and the magnet seal members, as shown in FIG. 2, the magnet seal member 34 is disposed near the poles N1, S2 and N2 of the magnet roller 32, and a lump of magnetic toner is held in this area so as to form a nip portion and seal it. Also, generally, the intervals among the magnetic poles of the magnet roller 32 are wide. Therefore, in the present embodiment, the magnetic poles of the magnet seal member 34 are disposed in opposed relationship with the magnetic poles of the magnet roller 32 to thereby form an N-S forward magnetic field, and the magnetic force of the magnet seal member 34 is made greater than the magnetic force of the magnet roller 32, whereby the slipping-through of the developer by the diffusion and movement of the toner and the leakage of the toner by a strong shock can be suppressed and prevented, and the magnetic poles of the magnet seal member 34 are disposed among the magnetic poles of the magnet roller 32 and the magnetic toner is restrained by the magnet seal member 34, whereby the sealing property is made good to among the magnetic poles as well.

Specifically, the magnet seal member 34 has poles S11, N12 and S14 disposed at locations opposed to the three magnetic poles N1, S2 and N2, respectively, of the magnet roller 32 in the developing sleeve 31, and cooperates with the magnet roller 32 to form an N-S magnetic field. Further, poles N1, S12 and poles S13, N13 are disposed at locations opposed to between the magnetic poles N1-S2 of the magnet roller 32 and to between the magnet poles S2-N2 of the magnet roller 32, respectively. And N and S poles are magnetized to multiple magnetic poles on the inner peripheral surface of the magnet seal member 34, and also on the magnetic poles N11, S12, S13 and N13 of the magnet seal member 34, the magnetic toner is restrained so that the sealing property can be made good.

In this case, a magnetic field comprising a magnetic field in the direction of the normal between adjacent magnetic poles of the magnet seal member 34 and a magnetic field in the tangential direction combined together is made great and by the action of this magnetic field, the magnetic toner is restrained, whereby the sealing property between adjacent magnetic poles can be made good. Specifically, the magnet seal member 34 is formed so that the value of the magnetic-flux density B at the position between the magnetic poles on the surface of the developing sleeve 31 singly by the magnet seal member 34 (a state in which it is not disposed on the developing sleeve) may be 80% or greater and 120% or less, and more preferably 90% or greater and 100% or less, of the value of the magnetic-flux density B of the magnetic pole position on the surface of the developer carrying member singly by the magnet seal member.

The magnetic-flux density β on the developing sleeve can be found by $$B=(Br^2+B\theta^2)^{1/2},$$

where Br is the magnetic-flux density [gauss] on the developing sleeve in the direction of the normal, and Bθ is the magnetic-flux density [gauss] on the developing sleeve in the tangential direction. The magnetic-flux density Br and the magnetic-flux density Bθ were measured by the use of the gauss meter and two-axis probe of the above-mentioned Bell Inc.

Figure 10:
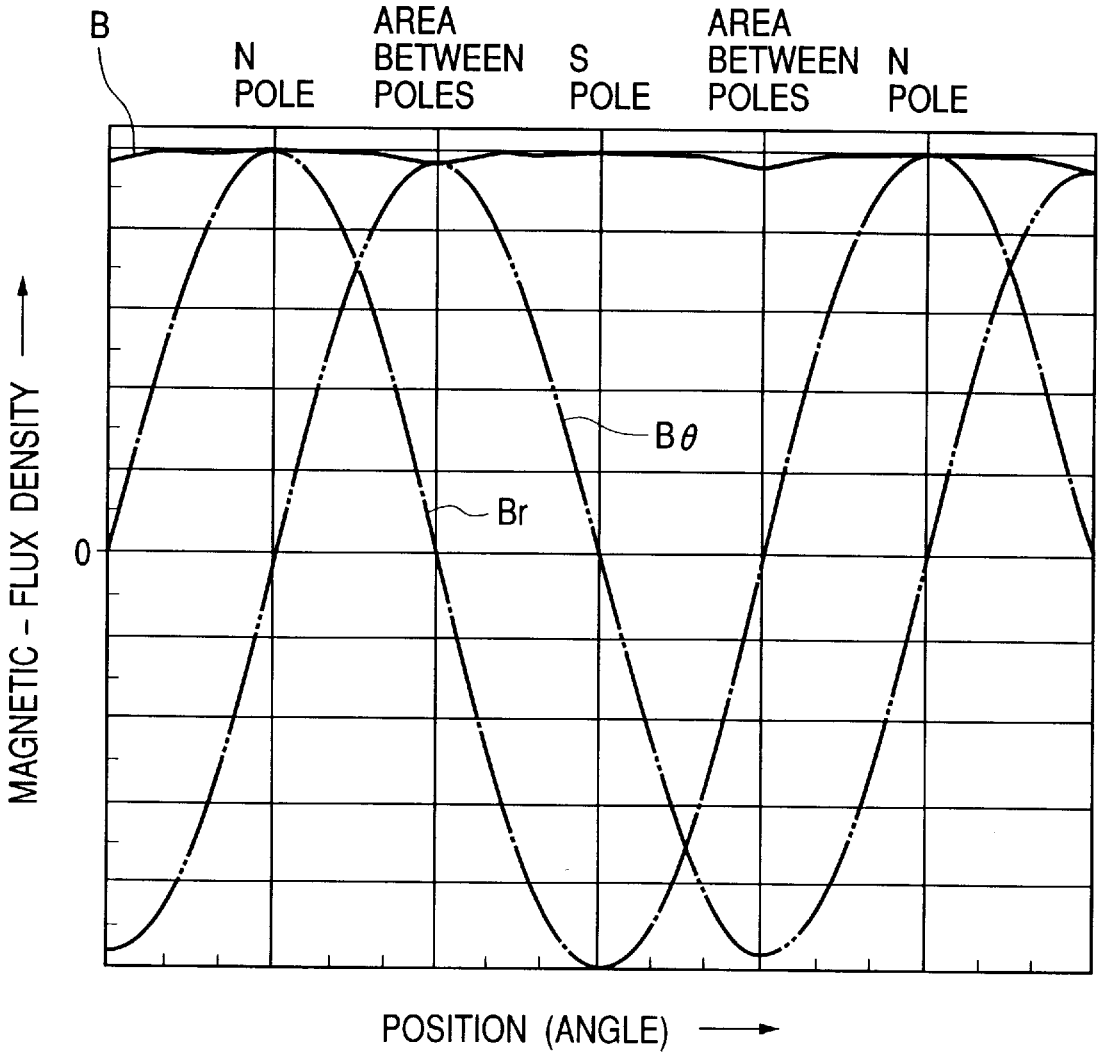
FIG. 10 is a graph representing the magnetic pole position at the surface position of the developing sleeve by a magnet seal member singly in an embodiment of the present invention and the distribution form of magnetic-flux density.
Figure 11:
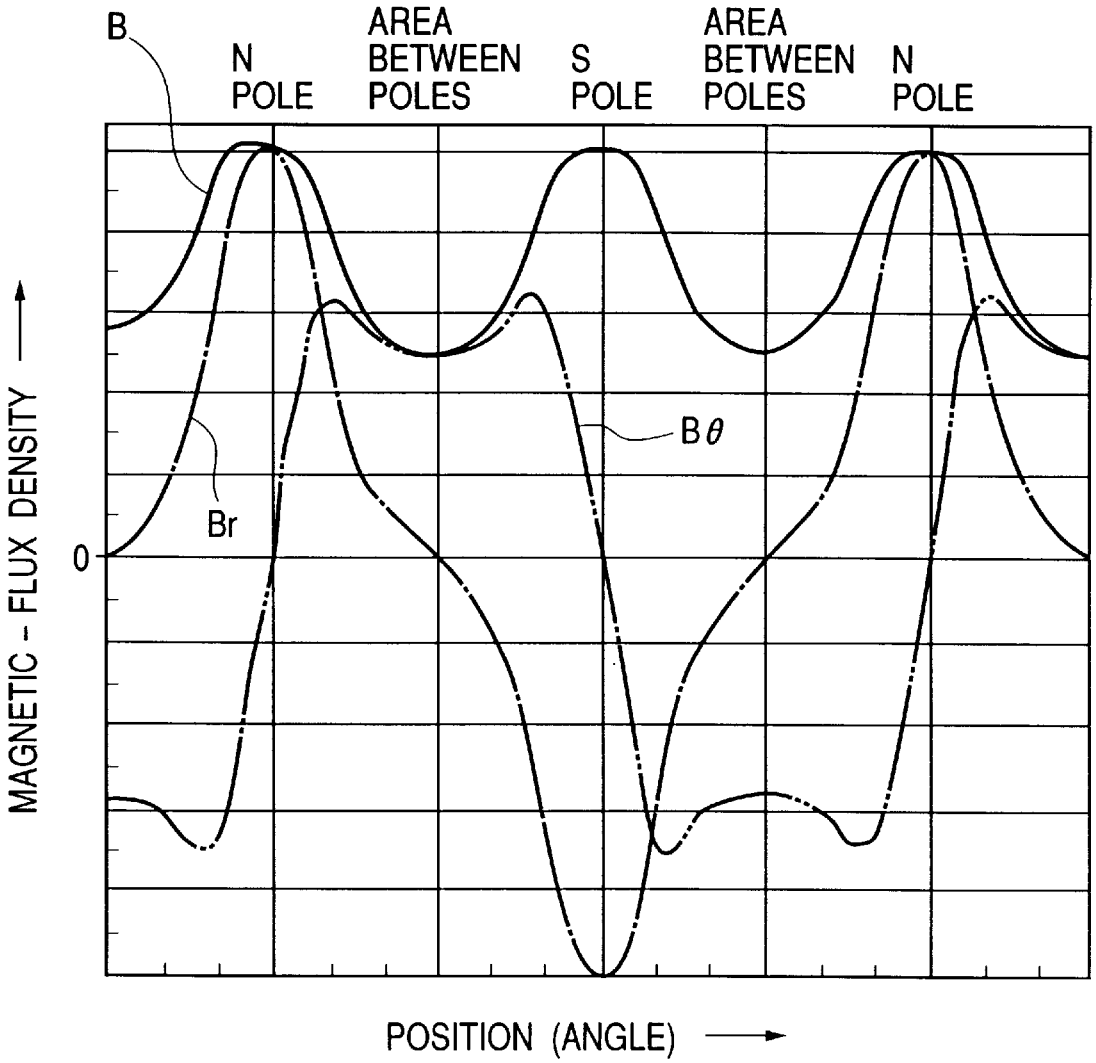
FIG. 11 is a graph representing the magnetic pole position at the surface position of the developing sleeve singly by the magnet seal member and the distribution form of magnetic-flux density.
Figure 12:
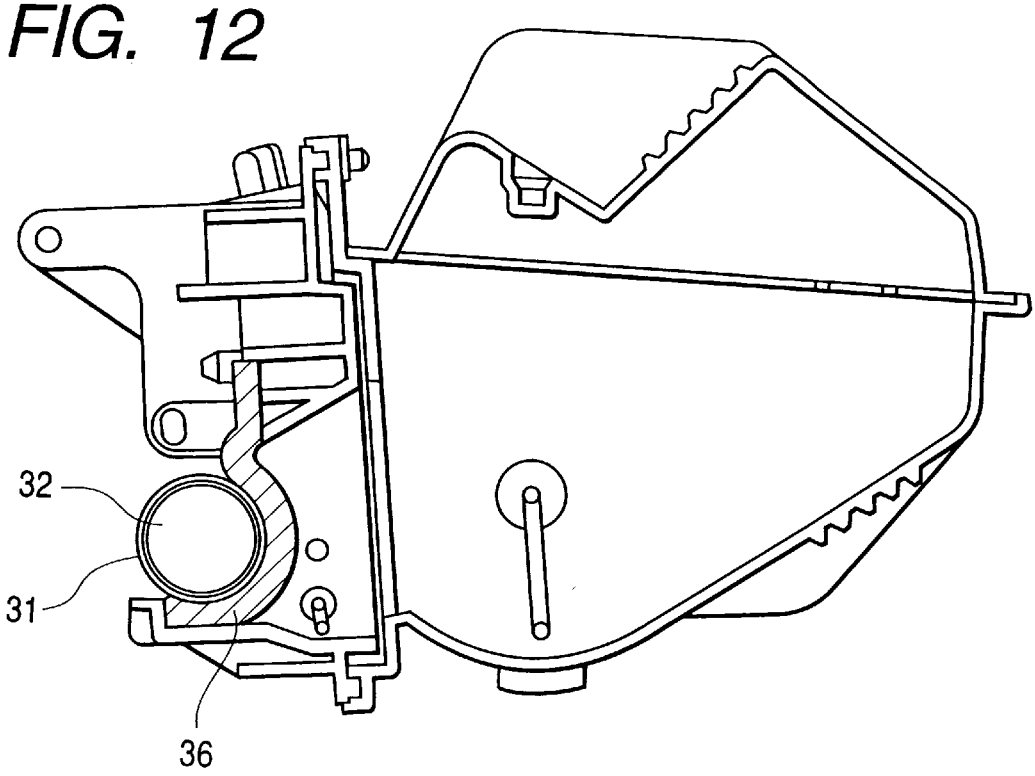
FIG. 12 is a front view showing a developing device according to the prior art.
Figure 13:
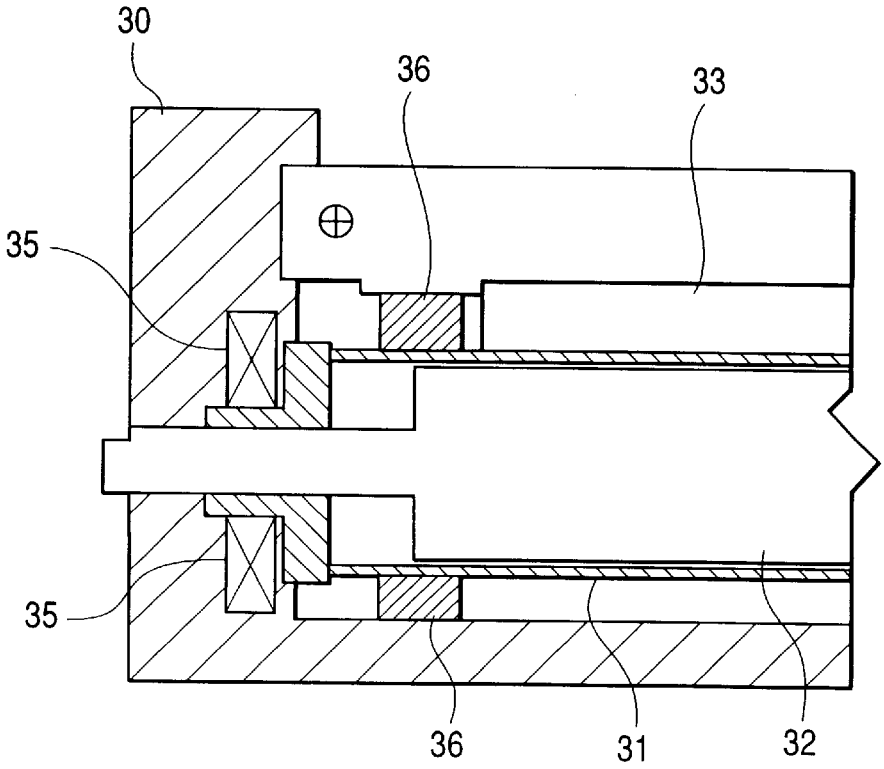
FIG. 13 is a lengthwise side view of the essential portions of the developing device according to the prior art.
Figure 14:
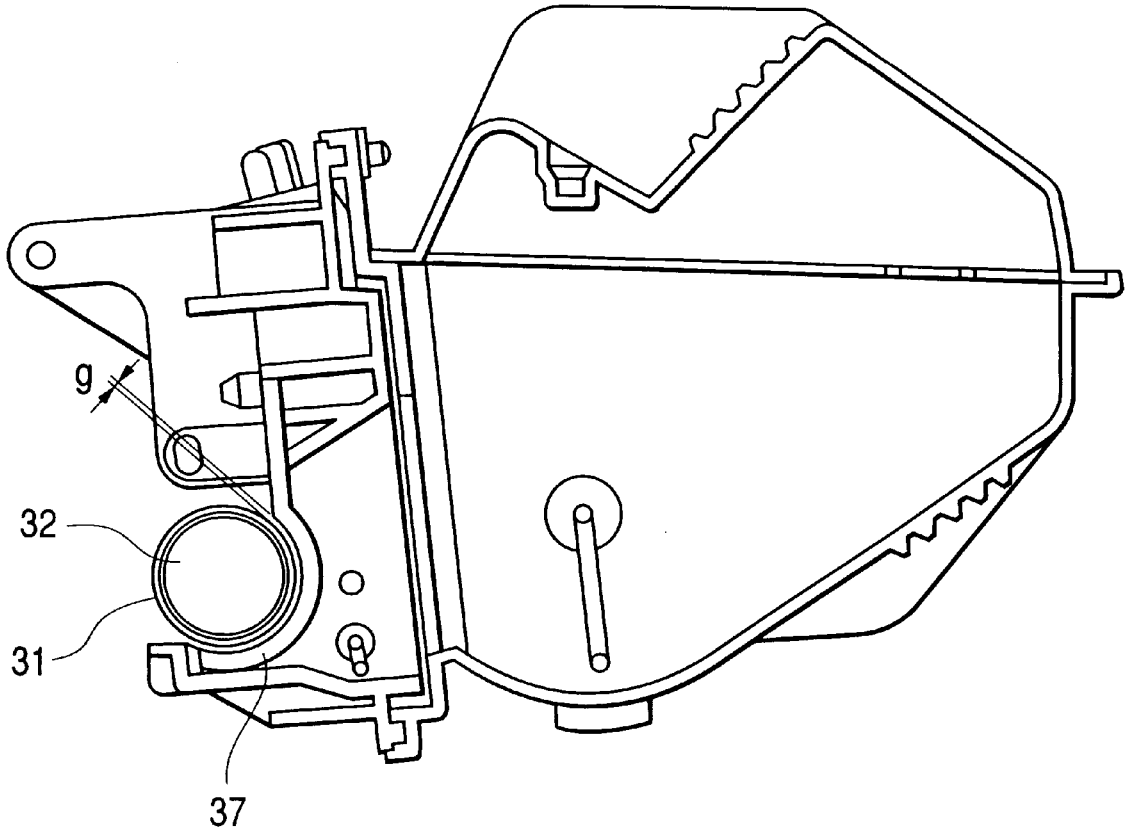
FIG. 14 is a front view showing a developing device using a magnet seal member according to the prior art.

The present embodiment and an example of the prior art will hereinafter be compared with each other by the use of graphs shown in FIGS. 10 and 11. FIG. 10 represents the magnetic pole positions and the form of distribution of magnetic-flux density at the surface position of the developing sleeve by the magnet seal member singly, in case where the magnet seal member of the present embodiment is provided with magnetic poles at the locations opposed to the magnetic poles of the magnet roller and among the magnetic poles. FIG. 11 represents the magnetic poles positions and the form of distribution of magnetic-flux density at the surface position of the developing sleeve by a magnet seal member singly, in case where the magnet seal member of the prior art is provided with magnetic poles only at locations opposed to the magnetic poles of the magnet roll. The axis of abscissas of each graph indicates the positions in the circumferential direction of the developing sleeve 31 by angles, and the axis of ordinates indicates the magnitudes of the magnetic-flux densities B, Br and Bθ on the sleeve.

According to FIG. 11, it will be seen that in the prior-art magnet seal member, among the magnetic poles, the magnetic-flux density B thereof is considerably lower than the magnetic-flux density B of the magnetic pole portion and the sealing property of that portion cannot be expected. In contrast, according to FIG. 10, it will be seen that in the magnet seal member of the present embodiment, the magnetic-flux density B between magnetic poles and the magnetic-flux density B of the magnetic pole portion are of substantially the same degree of magnitude. From this, it will be seen that as in the present embodiment, the magnetic-flux density B between magnetic poles is made great, whereby the sealing property can be made good between magnetic poles as well.

Further, in the present embodiment, at the surface position of the developing sleeve at all the developer nip portions by the magnet seal members 34 and the magnet roller 32, the magnitude of the magnetic force Fr singly by the magnet seal member in the direction of the normal to the surface position of the developing sleeve is made greater than the magnitude of the magnetic force Fr singly by the magnet roller in the direction of the normal to the surface position of the developing sleeve in an area opposed to the magnet seal member. Thereby, in the whole area of the developer nip portions, the amount of toner diffused and moved by the rotation of the developing sleeve can be suppressed so that the slipping-through of the developer can be effectively suppressed and prevented.

While the embodiment of the present invention has been described above, the magnet roller 32 used in the present embodiment can be a conventional magnet such as a ferrite magnet, an alnico magnet, an iron cobalt magnet or a rare earth magnet, and from the viewpoints of cost and weight, it is preferable that minute ferrite magnets dispersed in resin or rubber be formed as a magnet.

As the magnet seal member 34, use can be made of the above-mentioned conventional magnet used as the magnet roll, but it may preferably be formed by a rare earth magnet in that a high magnetic field is obtained.

The magnet roller 32 and the magnet seal member 34 may be formed by different kinds of magnets, and a ferrite magnet may be used as the magnet roller 32 and a rare earth magnet may be used as the magnet seal member 34, whereby by a simple construction, the magnetic force of the magnet seal member can be made greater than that of the magnet roller 32, and it becomes possible to suppress and prevent the slipping-through of the developer better, or suppress and prevent the leakage of the developer by a shock or the like better.

Further, when a rare earth magnet is used as the magnet seal member 34, the magnetic force of the magnet seal member can be made very great, and the slipping-through of the developer can be suppressed and prevented or the leakage of the developer by a shock or the like can be suppressed and prevented.

The above embodiment has been described with respect to a case where a magnetic toner is used as the magnetic developer in the developing device, but the use of a two-component magnetic developer comprising a non-magnetic toner and magnetic particles (carrier) as the developer also leads to the obtainment of a similar effect. Also, the developing device of each construction according to the present embodiment is provided in a process cartridge, whereas this is not restrictive, but the developing device of each described construction can also be disposed in an image forming apparatus.

While the embodiments of the present invention have been described above, the present invention is not restricted to these embodiments, but all modifications thereof are possible within the technical idea of the invention.

What is claimed is:

1. A developing device comprising:

a developing container containing a magnetic developer therein;

a developer carrying member provided in an opening portion of said developing container for carrying and conveying the developer thereon;

a developer carrying magnet provided immovably in said developer carrying member for causing said developer carrying member to carry the developer thereon by its own magnetic force; and a magnetic seal member provided adjacent to end portions of said developer carrying member for effecting sealing of the developer by its own magnetic force;

wherein at positions opposed to each magnetic pole of said developer carrying magnet in a sealing area of said magnetic seal member, on a surface of said developer carrying member, a magnitude Fr1 of magnetic force produced by said developer carrying magnet in a normal direction is smaller than magnitude Fr2 of magnetic force produced by said magnetic seal member in a normal direction.

2. A developing device according to claim 1, wherein said magnet seal member has magnetic poles of different polarities at positions substantially opposed to the magnetic poles of said developer carrying magnet.

3. A developing device according to claim 1, wherein the circumferential direction of said developer carrying member, Fr1 is smaller than Fr2 over the seal area of said magnet seal member.

4. A developing device according to claim 1, wherein said magnet seal member is provided along the circumferential direction of said developer carrying member with a predetermined gap therebetween.

5. A developing device according to claim 1, wherein said magnetic developer is a one-component magnetic toner.

6. A developing device according to claim 1, wherein said developing device is provided together with an image bearing member effecting a developing operation on a process cartridge detachably attachable to an image forming apparatus.

* * * * *

UNITED STATES PATENT AND TRADEMARK OFFICE

CERTIFICATE OF CORRECTION

PATENT NO. : 6,032,007
APPLICATION NO. : 09/146357
DATED : February 29, 2000
INVENTOR(S) : Masaaki Yamaji It is certified that error appears in the above-identified patent and that said Letters Patent is hereby corrected as shown below:

COLUMN 1

Line 9, “image bearing” should read --image-bearing--.

COLUMN 5

Line 55, delete “that”.

COLUMN 6

Line 57, “400 x $10^{31\ 4}$” should read --400 x $10^{-4}$--.

COLUMN 7

Line 34, “property, the” should read --property, if the--.
Line 67, “soley” should read --singly--.

COLUMN 8

Line 3, “soley” should read --singly--.

COLUMN 9

Line 46, “soley” should read --singly--.
Line 51, “soley” should read --singly--.

UNITED STATES PATENT AND TRADEMARK OFFICE

CERTIFICATE OF CORRECTION

PATENT NO. : 6,032,007
APPLICATION NO. : 09/146357
DATED : February 29, 2000
INVENTOR(S) : Masaaki Yamaji It is certified that error appears in the above-identified patent and that said Letters Patent is hereby corrected as shown below:

COLUMN 12

Line 4, "N1," should read --N11,--.

Signed and Sealed this

Twenty-fourth Day of July, 2007

JON W. DUDAS
*Director of the United States Patent and Trademark Office*